United States Patent [19]

Hebel

[11] Patent Number: 4,997,362

[45] Date of Patent: Mar. 5, 1991

[54] CERAMIC BURNER

[75] Inventor: Rudolf Hebel, Gensheim, Fed. Rep. of Germany

[73] Assignee: Didier-Werke AG, Wiesbaden, Fed. Rep. of Germany

[21] Appl. No.: 480,541

[22] Filed: Feb. 15, 1990

[30] Foreign Application Priority Data

Mar. 8, 1989 [DE] Fed. Rep. of Germany ..... 3907347

[51] Int. Cl.[5] ..... F23C 5/08

[52] U.S. Cl. ..... 431/177; 431/170; 432/217

[58] Field of Search ..... 431/170, 177; 432/217

[56] References Cited

U.S. PATENT DOCUMENTS 3,627,284 12/1971 Van Laar ..... 432/217
3,891,384 6/1975 Hovis et al. ..... 432/217
4,086,052 4/1978 Laux et al. .

FOREIGN PATENT DOCUMENTS 1551777 8/1973 Fed. Rep. of Germany .
2017290B 10/1979 United Kingdom .

*Primary Examiner*—Carroll B. Dority
*Attorney, Agent, or Firm*—Wenderoth, Lind & Ponack

[57] ABSTRACT

A ceramic burner is provided, particularly for use in a hot-blast oven, with a generally cylindrical wall defining a central burner duct and a housing extending around and spaced from the generally cylindrical wall to define an outer annular duct disposed coaxial to the central burner duct. The generally cylindrical wall includes an inner peripheral surface extending outwardly from a central burner duct to define a burner mouth. First and second ring nozzles are provided having openings extending from the outer annular duct and open at the burner mouth. Nozzle inserts are provided for insertion into the openings of the first and second ring nozzles so as to vary the cross-sectional area defined by the openings of the first and second ring nozzles. Additionally, injector grids are provided for insertion into the openings of the first and second ring nozzles so as to divide each of the openings into a plurality of smaller openings. The ceramic burner may also be provided with a third ring nozzle, extending from the outer annular duct and open at the central burner duct, which is located below the burner mouth.

25 Claims, 4 Drawing Sheets

1
2
9
12
W
3
13
12
11
10
10
7
4
7
6
8
5

2
1
9
12
a
b
13
c
11
16
10
18
16
6
14
4
7
15
23

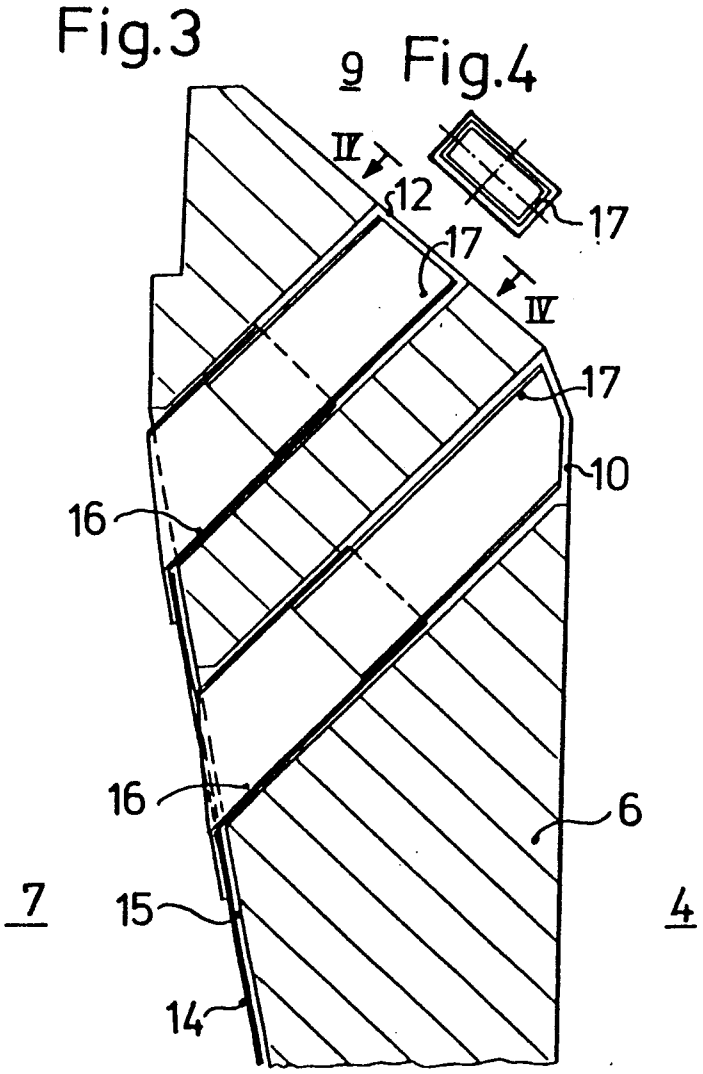
Fig.3
Fig.4
9
IV
12
17
17
17
IV
10
6
4
16
16
15
14
7
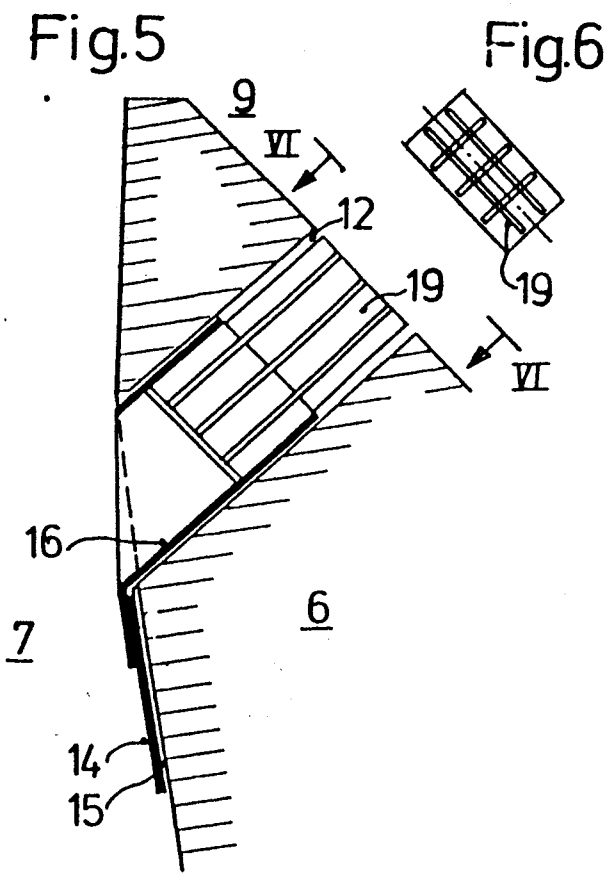
Fig.5
Fig.6
9
VI
12
19
19
VI
6
16
7
14
15

CERAMIC BURNER

BACKGROUND OF THE INVENTION

1. Field of the Invention

The present invention relates to a ceramic burner, particularly a ceramic burner of a hot-blast stove having a central burner duct for supply of a first combustion component, such as a combustible gas, and an outer annular duct disposed coaxial to the central burner duct for supplying a second combustion component, such as air.

2. Description of the Related Art

Conventionally, ceramic burners have been provided with a single ring nozzle having a plurality of openings extending from the outer annular duct to a burner mouth which extends outwardly from the central burner duct.

A burner of this type is disclosed in Federal Republic of Germany DE-OS No. 1551777, in which a single ring nozzle is provided having openings connecting the outer annular duct to the burner mouth for combining the first and second combustion components. In such a configuration, however, a deficient flame stabilization results, in particular when the throughput of the combustion media is high. When such a deficient flame stabilization is present, problems such as burn-out of the flame and oscillations of the flame can occur. Oscillations of the flame are particularly troublesome in that the burner can be excited to a pulsation condition, resulting in a high mechanical stress on the burner and, under some circumstances, further resulting in the generation of a significant level of noise within the hot-blast stove.

A second ring nozzle is disclosed in Federal Republic of Germany DE-OS No. 2809521. The second ring nozzle is located below the burner mouth, relative the flow direction of the combustible gas, and includes openings extending from the outer annular duct and open at the central burner duct. According to this configuration, a pre-mixing of the combustible gas and air is obtained. Pre-mixing in this manner, however, also results in a propensity of the burner to enter into a pulsation condition.

It is noted that Federal Republic of Germany DE-AS No. 2541991 also discloses a burner having a first ring nozzle open at the burner mouth and a second ring nozzle open at the central burner duct.

SUMMARY OF THE INVENTION

The object of the present invention is to provide a ceramic burner, particularly for use in a combustion shaft of a hot-blast stove, in which a low emission, efficient combustion is obtained for both high volumes and low volumes of combustion.

It is a further object of the present invention to provide a ceramic burner having a pulsation-free mode of operation to prevent damage thereto, particularly when the burner is operating with a comparatively large throughput of combustion media and a comparatively high furnace load.

It is a further object of the present invention to provide a ceramic burner having advantageous burn-out characteristics and a flame efficiency exceeding 95% in the stoichiometric operating range.

It is a further object of the present invention to provide a ceramic burner having a low emission, large throughput of combustible gas, and operating at a small calorific value.

It is a further object of the present invention to provide a ceramic burner for effecting a combustion which is low in pollutants and environmentally compatible to a large throughput of a blast furnace gas having gas additives such as coke oven gas, natural gas and converter gas, without creating audible noise in the burner system.

It is yet another object of the present invention to provide a ceramic burner having a comparatively low energy requirement and which compensates for a wide range of normal operating fluctuations in the supply of the combustion media.

It is yet another object of the present invention to provide a ceramic burner which operates within standardized emission regulations.

The above and other objects of the present invention are obtained by providing a ceramic burner having a first ring nozzle extending from the outer annular duct and open at the burner mouth; and by further providing a second ring nozzle extending from the outer annular duct and open at the burner mouth.

According to the configuration of the present invention, a plurality of small concentric spherical flames are obtained which burn in a locally stable manner. Energy wasting oscillations of the flames are therefore avoided. In this manner, a ceramic burner is provided which will not be excited to a pulsation mode so that the possibility of dynamic loading of the burner and the development of noises within the hot-blast stove is significantly reduced.

The openings at the burner mouth of the first ring nozzle are located so as to offset the openings at the burner mouth of the second ring nozzle. Thus, a fine spherical flame structure is obtained, having an absence of gaps, in two concentric circles at the burner mouth. It is preferable that an opening angle of the burner mouth range from 80° to 100°. As a result, a locally stable, efficient combustion is obtained.

Furthermore, according to the present invention, inserts are provided which are adapted to fit within the openings of the first and second ring nozzles. In this manner, the volume of air flowing through the ring nozzles can be adapted to meet the operating conditions of the system which may change due to the type of gas being combusted and other variables such as the required calorific value, and preheating or static pressure ratios.

Furthermore, according to the present invention, restrictor plates are provided and located in the outer annular duct. The restrictor plates include adjustable baffles, and are arranged between the ring nozzles.

In other embodiment of the present invention, a third ring nozzle is provided having openings extending from the outer annular duct and open at the central burner duct upstream from the burner mouth relative to the flow direction of the combustible gas. In this manner, a predetermined pre-mixing is obtained.

Still furthermore, to prevent deflagrations of the ceramic burner due to gas accumulations, a heat resistant metal band is provided enclosing refractory bricks which define the central burner duct. Furthermore, the metal band prevents unintended leakage passages between the outer annular duct and the central burner duct.

BRIEF DESCRIPTION OF THE DRAWINGS

The invention will be described in more detail below with reference to the exemplified embodiments thereof illustrated in the accompanying drawings, wherein:

FIG. 3 is a view depicting the nozzle inserts of the present invention.

FIG. 4 is a view taken along line IV—IV shown in FIG. 3.

FIG. 5 is a view depicting the injector grids of the present invention.

FIG. 6 is a view taken along line VI—VI shown in FIG. 5; and

DESCRIPTION OF THE PREFERRED EMBODIMENTS

Figure 1:
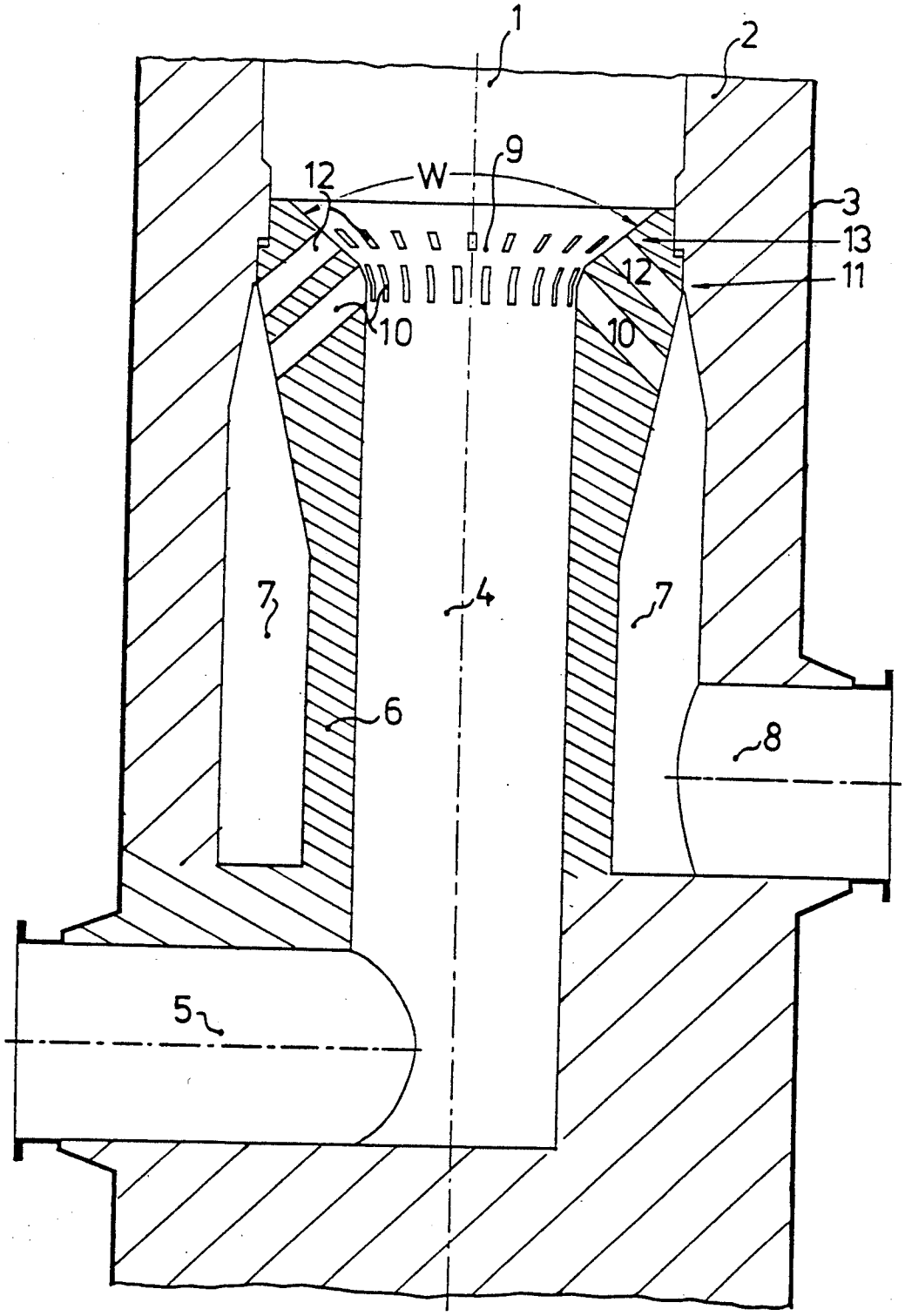
FIG. 1 is a longitudinal sectional view of a ceramic burner according to the present invention.

According to the present invention as shown in FIG. 1, a ceramic burner is provided having a combustion shaft 1 within a shell brickwork 2, which is enclosed by a plate shell 3.

A combustible gas channel 4 (central burner duct) is connected to a gas connecting piece 5 for supply of a combustible gas. The combustible gas channel 4 is separated from a combustion air ring channel 7 (outer annular duct) by means of a cylindrical wall 6 made of refractory bricks. A combustion air connecting piece 8 is connected to the combustion air ring channel 7 for supply of the air component. The combustible gas channel 4 interfaces with the combustion shaft 1 via a burner mouth 9. The burner mouth preferably has a opening angle W ranging from 80 ° to 100°. Openings 10 which define the first ring nozzle 11 and openings 12 which define the second ring nozzle 13 open at the burner mouth 9 as shown. That is, the openings 10, 12 extend from the combustion air ring channel 7 and are open at the burner mouth 9. During operation, a core flame is generated at each of the openings 10, 12 of the ring nozzles 11, 13.

The openings 12 are located further downstream than the openings 10 relative the flow direction. More particularly, the openings 10 are located at the interface between the burner mouth 9 and the combustible gas channel 4. Furthermore, the openings 10 are located so as to off-set the openings 12. That is, the openings 10 are located between the gaps defined by the openings 12.

Figure 2:
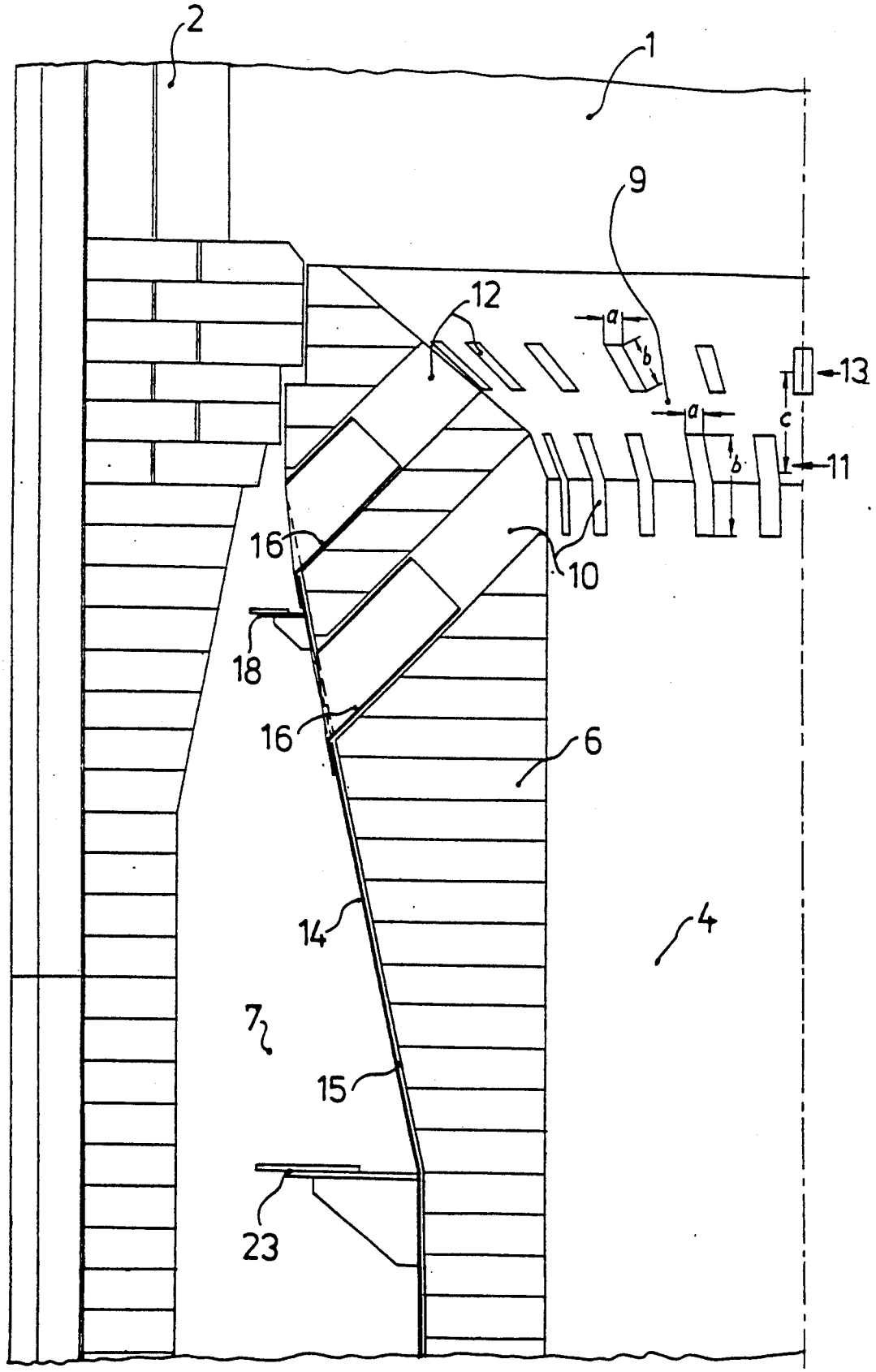
FIG. 2 is a longitudinal sectional view of the region of the burner mouth of the ceramic burner of the present invention.

Referring now to FIG. 2, the ratio between the width "a" of the nozzles 10, 12 and their length "b" is preferably at most 1:4.4. Furthermore, the rectangular openings 10 and the rectangular openings 12 are preferably identical to each other. However, depending on usage conditions, the cross-sectional area defined by the openings 10 can deviate from that of the openings 12.

The average distance "c" between the center portions of the ring nozzles 11, 13 is approximately 7 to 8 times greater than the width "a" of the openings 10, 12. In the preferred embodiment, the mean distance "c" is 7.8 times the width "a" of the openings 10, 12.

The cylindrical wall 6 is enclosed by a cylindrical metallic jacket 14. The metallic jacket 14 is preferably assembled in several annular bands having flange connections therebetween. An expansion allowance 15 is provided between the metallic band 14 and the cylindrical wall 6 and is preferably realized by a refractory insulating mat. Metallic attaching mechanisms 16 extend into the openings 10, 12 and are connected to the metallic band 14. The metallic attaching mechanisms 16 are designed to hold the nozzle inserts 17 and/or the injector grids 19 in place (See FIGS. 3-6).

A restrictor plate 18 is attached to the metallic band 14 between the ring nozzles 11, 13. The restrictor plate 18 is preferably metallic and is further provided with an adjustable baffle to obtain a desired division of the flow of air between the ring nozzles 11, 13.

Referring now to FIGS. 3-6, nozzle inserts 17 are provided and are preferably of a metallic or ceramic material. The nozzle inserts 17 are adapted for insertion into the openings 10, 12 so as to reduce the cross-sectional opening area defined by the openings 10, 12. It is noted that the nozzle inserts 17 may be inserted into the openings 10, 12 from the combustion air ring channel 7, so that the operation of the burner may not be interrupted.

Furthermore, according to the present invention, injector grids 19 are provided which are adapted to fit within the openings 10, 12 and mounted to the attaching mechanisms 16. The injector grids 19 serve to divide the air current flowing to the openings 10, 12. Accordingly, flame stability is further enhanced. The injector grids 19 are preferably made of a ceramic material such as recrystallized SiSiC.

Figure 7:
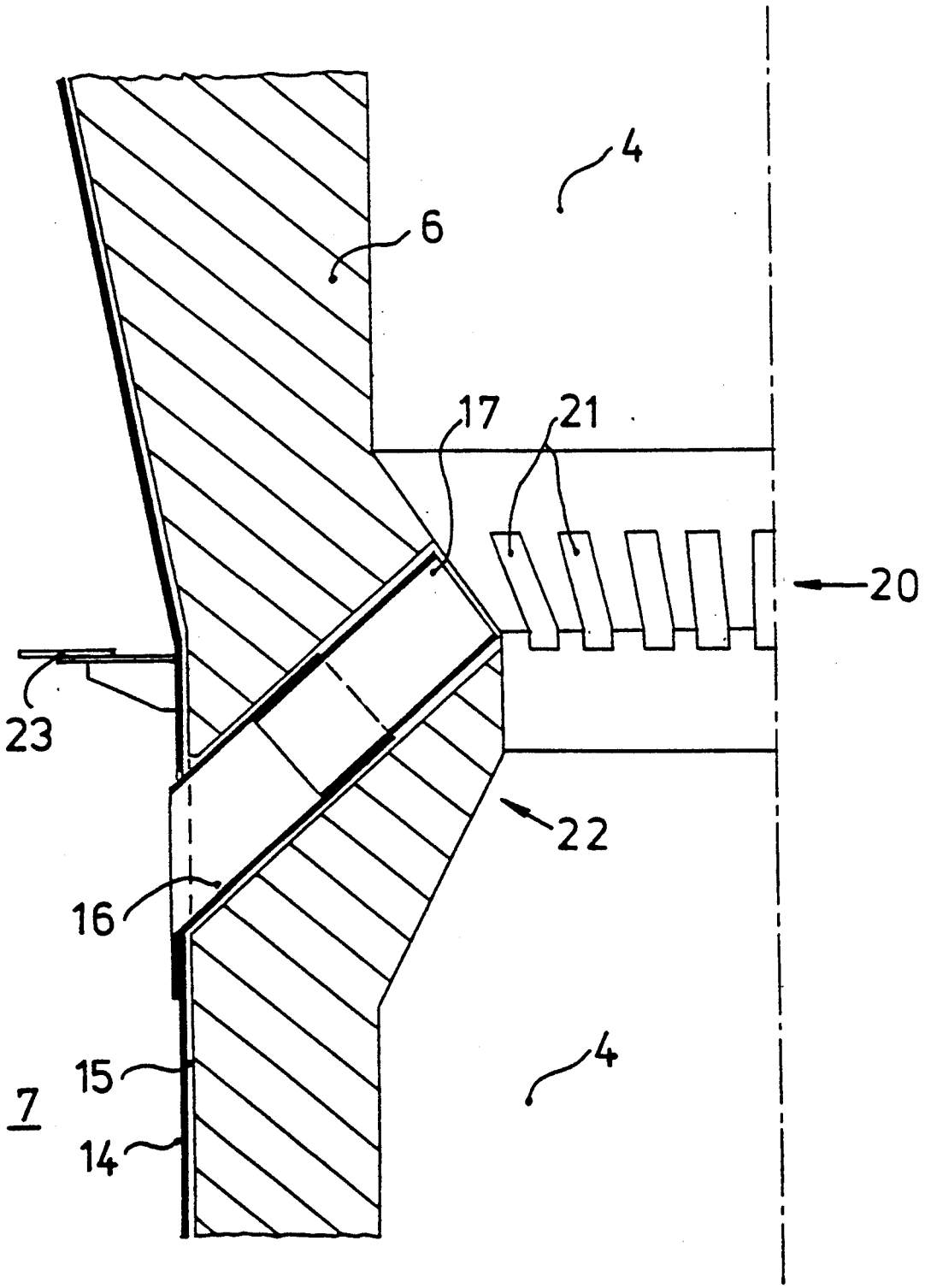
FIG. 7 is a longitudinal sectional view of the ceramic burner according to another embodiment of the present invention in which a third ring nozzle is located below the burner mouth.

Referring now to FIG. 7, according to another embodiment of the present invention, a third ring nozzle 20 is provided having openings 21. That is, the openings 21 extend from the combustion air ring channel 7 and open at the combustible gas channel 4. The third ring nozzle 20 is located upstream from the burner mouth 9 relative the flow direction. The third ring nozzle 20 provides a pre-mixing of the combustible gas and air.

In the region of the third ring nozzle 20, the cylindrical wall 6 extends inwardly to form a Laval type nozzle as shown in FIG. 7. Furthermore, the openings 21 of the third ring nozzle 20 open in the region of the combustible gas channel 4 which extends inwardly as shown FIG. 7.

Attaching mechanisms 16 for holding the nozzle inserts 17 or injector grids 19 are also provided for the openings 21 of the third ring nozzle 20.

Furthermore, another restrictor plate is provided which is located above the third ring nozzle in the combustion air ring channel 7. The air current distribution between the third ring nozzle 20 and the ring nozzles 11, 13 can thus be controlled using the restrictor plate 23.

The minimum total number Z of openings 10, 12 is based on the designed throughput volume V ($Nm^3/h$) of the combustible gas. More particularly, the minimum total number Z of openings 10, 12 is determined in accordance with the following equation:

$$Z = V/1250.$$

The total number Z of openings 10, 12 is determined accordingly, and the openings 10, 12 are distributed uniformly along the ring nozzles 11, 13.

According to the above-described configuration, fine flames, which have little impact on each other, are generated at each of the openings 10, 12 of the two ring nozzles 11, 13. Accordingly, a stable combustion behavior is achieved. In this manner, energetic oscillations which create pulsations are avoided.

Furthermore, the operation of the ceramic burner may be further tuned by inserting the nozzle inserts 17 or injector grids 19 into the openings 10, 12 of the ring nozzles 11, 13, and by adjusting the restrictor plate 18 as well. Accordingly, the air current velocity and the volume flow can be adjusted to achieve an acoustically capacitive behavior at the burner mouth. In addition, a flame frequency can be obtained that exceeds a critical basic frequency (infrasonic range) of the burner-combustion shaft of the system.

Furthermore, insertion of the nozzle inserts 17 and injector grids 19, and setting of the restrictor plate 18 can be achieved without interruption of the ceramic burner operation since the nozzle inserts 17, the injector grids 19 and the restrictor plate 18 are readily accessible from the combustion air ring channel 7.

Furthermore, pre-mixing of the air and the combustible gas is achieved by the placement of a third ring nozzle 20 disposed below the burner mouth 9.

Finally, deflagrations are prevented by providing a metallic jacket 14 enclosing the cylindrical wall 6. Additionally, the metallic band 14 prevents unintended leakage passages from being present between the combustion air ring channel 7 and the combustible gas channel 4.

It is to be understood that modifications may be made to the above-described structural arrangement without departing from the scope of the present invention.

What is claimed is:

1. A burner comprising:

a wall defining a central burner duct for allowing a first combustion component to pass therethrough in a flow direction;

a housing extending around and spaced from said wall so as to define an outer annular duct disposed coaxial to said central burner duct for allowing a second combustion component to pass therethrough in said flow direction;

said wall having an inner peripheral surface extending outwardly from said central burner duct in said flow direction to define a burner mouth;

said wall having a first ring nozzle placing said central burner duct in communication with said outer annular duct for combining the first and second combustion components, said first ring nozzle including a first plurality of openings extending from said outer annular duct and open at said inner peripheral surface that defines said burner mouth;

said wall having a second ring nozzle placing said central burner duct in communication with said outer annular duct for combining the first and second combustion components, said second ring nozzle including a second plurality of openings extending from said outer annular duct and open at said inner peripheral surface that defines said burner mouth;

said second ring nozzle being located downstream from said first ring nozzle relative said flow direction.

2. A burner as recited in claim 1, wherein each of said first plurality of openings is located approximately equidistant from each adjacent opening of said first plurality of openings, and wherein each of said second plurality of openings is located approximately equidistant from each adjacent opening of said second plurality of openings, and wherein said first plurality of openings are offset along said inner peripheral surface relative said second plurality of openings.

3. A burner as recited in claim 1, wherein a cross-sectional opening area defined by each of said first and second plurality of openings extends a predetermined width and a predetermined length, and wherein a ratio of said predetermined width to said predetermined length is at most 1:4.4.

4. A burner as recited in claim 2, wherein a cross-sectional opening area defined by each of said first and second plurality of openings extends a predetermined width and a predetermined length, and wherein a ratio of said predetermined width to said predetermined length is at most 1:4.4.

5. A burner as recited in claim 1, wherein a cross-sectional opening area defined by each of said first and second plurality of openings extends a predetermined width and a predetermined length, and wherein each of said first and second plurality of openings are respectively spaced from each adjacent opening of said first and second plurality of openings by a distance which is approximately 7 to 8 times greater than said predetermined width.

6. A burner as recited in claim 2, wherein a cross-sectional opening area defined by each of said first and second plurality of openings extends a predetermined width and a predetermined length, and wherein each of said first and second plurality of openings are respectively spaced from each adjacent opening of said first and second plurality of openings by a distance which is approximately 7 to 8 times greater than said predetermined width.

7. A burner as recited in claim 3, wherein each of said first and second plurality of openings are respectively spaced from each adjacent opening of said first and second plurality of openings by a distance which is approximately 7 to 8 times greater than said predetermined width.

8. A burner as recited in claim 4, wherein each of said first and second plurality of openings are respectively spaced from each adjacent opening of said first and second plurality of openings by a distance which is approximately 7 to 8 times greater than said predetermined width.

9. A burner as recited in claim 1, wherein an angle extending in said flow direction and defined by opposite sides of said inner peripheral surface that defines said burner mouth is approximately 80° to 100°.

10. A burner as recited in claim 2, wherein an angle extending in said flow direction and defined by opposite sides of said inner peripheral surface that defines said burner mouth is approximately 80° to 100°.

11. A burner as recited in claim 1, wherein a number of said first and second plurality of openings equals approximately a predetermined throughput volume of the first combustion component divided by 1,250.

12. A burner as recited in claim 2, wherein a number of said first and second plurality of openings equals approximately a predetermined throughput volume of the first combustion component divided by 1,250.

13. A burner as recited in claim 3, wherein a number of said first and second plurality of openings equals approximately a predetermined throughput volume of the first combustion component divided by 1,250.

14. A burner as recited in claim 5, wherein a number of said first and second plurality of openings equals approximately a predetermined throughput volume of the first combustion component divided by 1,250.

15. A burner as recited in claim 1, said wall having a third ring nozzle placing said central burner duct in communication with said outer annular duct for combining the first and second combustion components, said third ring nozzle including a third plurality of openings extending from said outer annular duct and open at said central burner duct, said third ring nozzle being located upstream from said burner mouth relative said flow direction.

16. A burner as recited in claim 15, further comprising a first restrictor plate located in said outer annular duct between said second ring nozzle and said first ring nozzle, and a second restrictor plate located in said outer annular duct between said first ring nozzle and said third ring nozzle.

17. A burner as recited in claim 16, wherein each of said first and second restrictor plates includes an adjustable baffle and is comprised of at least one of a metallic material and a ceramic material.

18. A burner as recited in claim 15, wherein said third ring nozzle is further defined by a first inner peripheral surface of said wall extending inwardly in said central burner duct, said first inner peripheral surface having a decreasing diameter in said flow direction, and a second inner peripheral surface of said wall extending inwardly in said central burner duct, said second inner peripheral surface having an increasing diameter in said flow direction and located downstream from said first inner peripheral surface relative said flow direction, wherein said third plurality of openings open at said second inner peripheral surface of said third ring nozzle.

19. A burner as recited in claim 16, wherein said third ring nozzle is further defined by a first inner peripheral surface of said wall extending inwardly in said central burner duct, said first inner peripheral surface having a decreasing diameter in said flow direction, and a second inner peripheral surface of said wall extending inwardly in said central burner duct, said second inner peripheral surface having an increasing diameter in said flow direction and located downstream from said first inner peripheral surface relative said flow direction, wherein said third plurality of openings open at said second inner peripheral surface of said third ring nozzle.

20. A burner as recited in claim 1, further comprising a plurality of nozzle inserts each adapted for insertion into at least one of said first and second plurality of openings so as to decrease an effective cross-sectional opening area defined by each of said first and second plurality of openings.

21. A burner as recited in claim 15, further comprising a plurality of nozzle inserts each adapted for insertion into at least one of said first and second and third plurality of openings so as to decrease an effective cross-sectional opening area defined by each of said first and second and third plurality of openings.

22. A burner as recited in claim 1, further comprising a plurality of injector grids each adapted for insertion into at least one of said first and second plurality of openings so as to divide said at least one of said first and second plurality of openings into a plurality of smaller openings.

23. A burner as recited in claim 15, further comprising a plurality of injector grids each adapted for insertion into at least one of said first and second and third plurality of openings so as to divide said at least one of said first and second and third plurality of openings into a plurality of smaller openings.

24. A burner as recited in claim 1, wherein said wall comprises refractory bricks enclosed at least in part by a metallic jacket.

25. A burner as recited in claim 15, wherein said wall comprises refractory bricks enclosed at least in part by a metallic band.

* * * * *